US009808961B2

(12) United States Patent
Jenkins

(10) Patent No.: US 9,808,961 B2
(45) Date of Patent: Nov. 7, 2017

(54) ELECTRIC DUST FREE SAW

(71) Applicant: Tim Jenkins, Columbia Station, OH (US)

(72) Inventor: Tim Jenkins, Columbia Station, OH (US)

(73) Assignee: Tim Jenkins, Columbia Station, OH (US)

( * ) Notice: Subject to any disclaimer, the term of this patent is extended or adjusted under 35 U.S.C. 154(b) by 99 days.

(21) Appl. No.: 15/009,962

(22) Filed: Jan. 29, 2016

(65) Prior Publication Data

US 2016/0221222 A1 Aug. 4, 2016

Related U.S. Application Data

(60) Provisional application No. 62/109,683, filed on Jan. 30, 2015.

(51) Int. Cl.
*B28D 1/04* (2006.01)
*B28D 7/02* (2006.01)

(52) U.S. Cl.
CPC ..... *B28D 1/045* (2013.01); *B28D 7/02* (2013.01)

(58) Field of Classification Search
CPC ..... B28D 1/045; B28D 7/02
USPC ..... 125/14; 451/350–353
See application file for complete search history.

(56) References Cited

U.S. PATENT DOCUMENTS

| | | | | | |
|---|---|---|---|---|---|
| 2,736,311 | A * | 2/1956 | Coates | B28D 1/044 | 104/307 |
| 4,375,212 | A * | 3/1983 | Santschi | B28D 1/045 | 125/14 |
| 4,928,662 | A * | 5/1990 | Chiuminatta | B24B 19/02 | 125/13.01 |
| 5,381,780 | A * | 1/1995 | Yelton | B25G 1/04 | 125/13.01 |
| 5,664,553 | A * | 9/1997 | Chiuminatta | B28D 1/045 | 125/13.01 |
| 5,669,371 | A * | 9/1997 | Rupprecht | B27B 9/00 | 125/12 |
| 6,349,712 | B1 * | 2/2002 | Halstead | B28D 1/045 | 125/12 |
| 6,478,666 | B1 * | 11/2002 | Berger | B24B 19/02 | 125/13.01 |
| 8,186,762 | B2 * | 5/2012 | Aronsson | B23D 47/02 | 299/39.3 |
| 2003/0159308 | A1 * | 8/2003 | Field | B05D 3/067 | 34/275 |
| 2005/0067801 | A1 * | 3/2005 | Copland | B60B 33/0002 | 280/33.991 |
| 2005/0121959 | A1 * | 6/2005 | Kruse | A61G 5/006 | 297/330 |
| 2006/0143844 | A1 * | 7/2006 | Klucznik | A47L 11/03 | 15/50.1 |
| 2008/0100036 | A1 * | 5/2008 | Ivanchenko | A61G 5/006 | 280/648 |

(Continued)

*Primary Examiner* — George Nguyen
(74) *Attorney, Agent, or Firm* — Mark E. Bandy; Rankin, Hill & Clark LLP

(57) ABSTRACT

Various cutting systems using a handheld electrically powered rotary cutting tool are described. The systems include a wheeled base having provisions for receiving and removably engaging an electric cutting tool. The systems also include an upwardly extending handle and provisions for collecting dust and debris during a cutting operation.

14 Claims, 16 Drawing Sheets

(56) References Cited

U.S. PATENT DOCUMENTS

| | | | | |
|---|---|---|---|---|
| 2008/0150347 | A1* | 6/2008 | Moller | B23D 59/001 299/1.5 |
| 2009/0236900 | A1* | 9/2009 | Due | B28D 7/02 299/39.3 |
| 2013/0247897 | A1* | 9/2013 | Ruffner | B23D 47/12 125/14 |
| 2014/0224237 | A1* | 8/2014 | Ronzello, Sr. | B28D 7/02 125/13.01 |
| 2016/0368166 | A1* | 12/2016 | Numata | B28D 7/02 |

* cited by examiner

ELECTRIC DUST FREE SAW

CROSS REFERENCE TO RELATED APPLICATION

This application is a nonprovisional application claiming priority upon U.S. Ser. No. 62/109,683 filed Jan. 30, 2015.

FIELD

The present subject matter relates to electrically powered cutting tools, and particularly a concrete cutting saw having dust and debris collection provisions.

BACKGROUND

Walk-behind cutting saws for concrete are typically large, heavy, and difficult to transport. For example, transporting a typical concrete cutting saw requires a truck or trailer with ramps. After loading and transporting to a different jobsite, ramps must be used again to unload the saw.

Another disadvantage associated with concrete cutting saws is the large amount of dust and debris resulting from a typical cutting operation. Such dust and debris can be particularly problematic when cutting indoors. Although dust collecting assemblies are known, their use often obscures an operator's view of the cutting area, and particularly blade position.

In view of these and other concerns, a need exists for an improved cutting tool.

SUMMARY

The difficulties and drawbacks associated with previous approaches are addressed in the present subject matter as follows.

In one aspect, the present subject matter provides a cutting system comprising a wheeled base unit having (i) provisions for receiving and removably engaging a handheld electric rotary cutting tool, and (ii) provisions for adjustably positioning the cutting tool relative to the wheeled base. The cutting system also comprises a handle assembly secured to the base unit. And, the cutting system comprises provisions on the wheeled base unit for collecting dust and debris resulting from a cutting operation.

In another aspect, the present subject matter provides a cutting system comprising a base unit having at least one wheel and provisions for receiving and removably engaging a handheld electric rotary cutting tool including a powered shaft rotatable in a first direction. The provisions (i) enable the cutting tool to be engaged relative to the base unit in a first position such that upon rotation of the powered shaft of the cutting tool in the first direction, the shaft rotates in an up-cut direction and (ii) also enable the cutting tool to be engaged relative to the base unit in a second position such that upon rotation of the powered shaft of the cutting tool in the first direction, the shaft rotates in a down-cut direction. The cutting system also comprises a handle assembly secured to the base unit.

In still another aspect, the present subject matter provides a cutting system comprising a base unit having at least one wheel and provisions for receiving and removably engaging a handheld electric rotary cutting tool having a powered shaft in either (i) a first position such that upon rotation of the powered shaft of the cutting tool in a first direction, the shaft rotates in an up-cut direction, or (ii) a second position such that upon rotation of the powered shaft of the cutting tool in the first direction, the shaft rotates in a down-cut direction. The cutting system also comprises a first dust and debris collection system positioned on the base unit to collect dust and debris from the cutting tool when the cutting tool is engaged to the base unit and in the first position. The cutting system also comprises a second dust and debris collection system positioned on the base unit to collect dust and debris from the cutting tool when the cutting tool is engaged to the base unit and in the second position.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
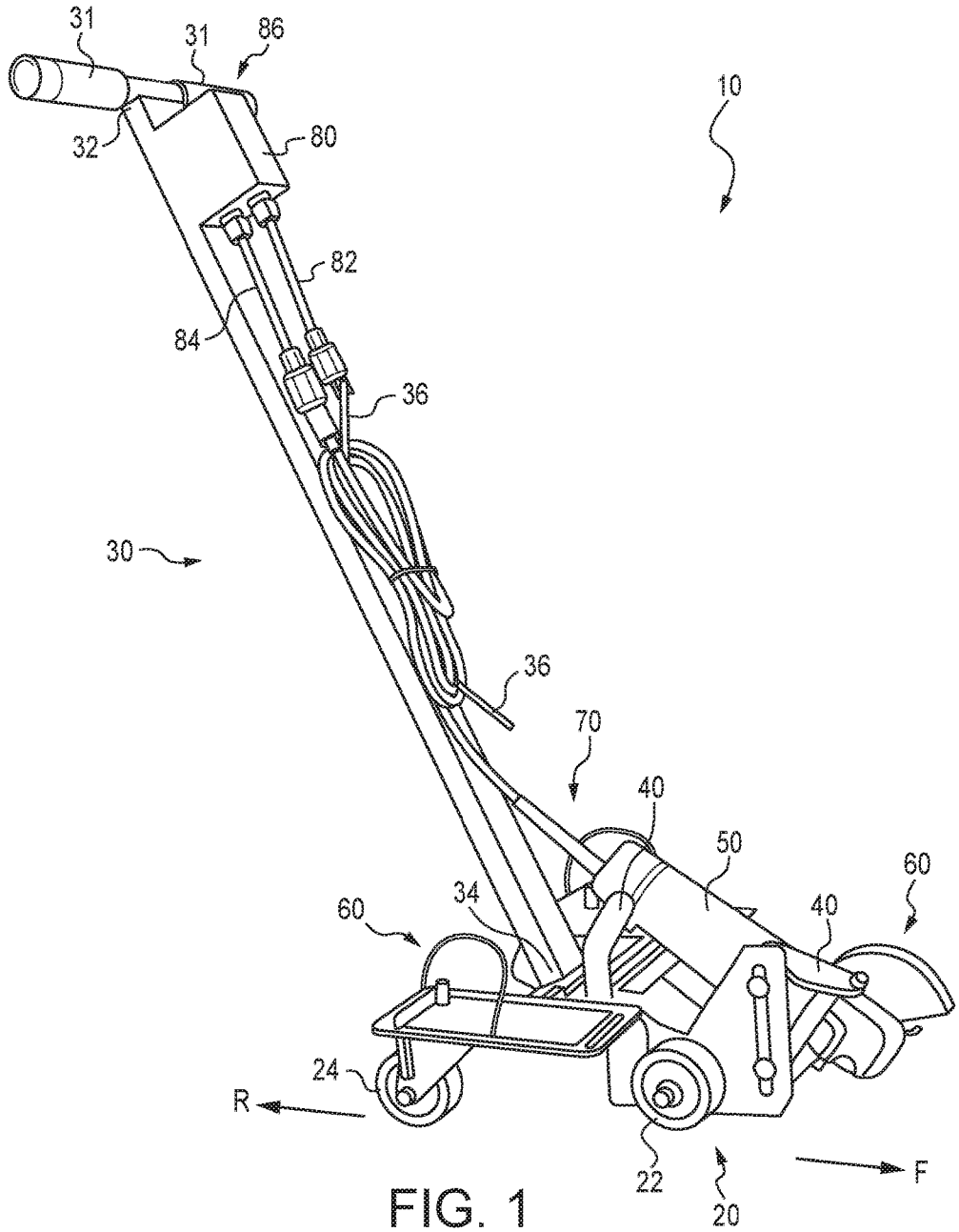
FIG. 1 is a front perspective view of an embodiment of a cutting system in accordance with the present subject matter.

The present subject matter provides new and unique cutting tools that utilize an electrically powered rotary blade that is incorporated in a wheeled base. The cutting tools include one or more handles positioned for an operator typically standing or walking in front or behind the wheeled cutting tool. In many embodiments, the cutting tools include provisions for collecting dust and debris resulting from a cutting operation.

The present subject matter also provides various wheeled assemblies for use with removable handheld electrically powered cutting tools. The assemblies enable a handheld electric cutting tool, separate from the wheeled assembly, to be selectively engaged therewith. Upon incorporation and engagement of the cutting tool in the wheeled assembly, the resulting cutting system facilitates cutting a variety of materials or substrates upon which the assembly is positioned and/or moved across. In many embodiments, the wheeled assemblies also include provisions for collecting dust and debris resulting from a cutting operation.

The present subject matter additionally provides various cutting systems that use an electrically powered rotary blade assembly which is incorporated in a wheeled base unit. The electrically powered rotary blade assembly is removably mounted in a wheeled base. The wheeled base unit includes provisions to selectively position, i.e., angle or tilt, the electrically powered rotary blade assembly, relative to the wheeled base. The wheeled base includes at least one wheel, and in many versions a collection of wheels which enable the cutting tool to be easily moved. The cutting systems also include one or more handles, typically mounted or secured to the wheeled base. One of the handles extends upward to a height of about 30 to 42 inches, and typically about 36 inches, to provide convenient gripping by an operator typically walking behind, in front, or alongside the unit during cutting. In certain versions, the cutting systems also include provisions for collecting dust and debris which typically are emitted during a cutting operation.

The present subject matter also provides various devices for use with handheld electrically powered cutting tools. The devices include a wheeled base unit, a handle assembly, provisions for incorporating a handheld electric cutting tool and adjustably positioning the tool relative to the wheeled base, and may additionally include provisions for collecting dust and debris resulting from a cutting operation.

The devices and assemblies, and cutting tools mounted therein, can be used for cutting an assortment of materials including concrete, masonry materials, and tile, for example. In many versions of the present subject matter, the devices and systems as described herein are particularly adapted for cutting concrete. However, it will be understood that the present subject matter systems and devices are not limited to cutting concrete and instead, include a wide array of other applications and uses.

As noted, in many embodiments, the cutting tools and related devices include provisions for collecting dust and debris. These provisions can include one or more channels or pathways formed within or alongside the wheeled base through which the dust and debris are directed. One or more dust collection tube(s) is provided in the wheeled base unit at which a reservoir can be connected. In certain applications, it may be beneficial to attach a vacuum source at the dust collection tube, or in communication therewith, to promote or facilitate such collection.

These and other aspects of the present subject matter are described herein and depicted in the referenced drawings.

Electric Cutting Tools

As noted herein, the wheeled assemblies or base units of the cutting systems receive and removably engage a variety of electric rotary cutting tools. In many versions of the present subject matter, the electric rotary cutting tools are sized and shaped to be easily gripped and used by an operator and are referred to herein as "handheld." The handheld electric rotary cutting tool typically includes (i) a housing, (ii) an electrically powered motor disposed in the housing, (iii) a rotatable shaft powered by the motor and transversely oriented to an axis of the motor, and (iv) actuation controls for controlling operation of the tool, in which the actuation controls are accessible along the housing of the tool.

The electrically powered cutting tool can be in the form of a commercially available rotary tool such as for example those available from Metabo US, DeWalt Tool, and Makita Tools. Many of these tools are referred to in the art as "angle grinders" and are used in the present subject matter systems by installing a rotary cutting blade in place of the grinding disc. Representative blade sizes, i.e., diameters, typically are from about 6 to 12 inches with 9 inches suitable for use with many cutting systems. Nonlimiting examples of commercially available angle grinders which are potentially suitable for use with the present subject matter cutting systems include those providing a torque within a range of from 40 to 200 in-lbs, and a no-load speed within a range of from about 2,000 to 12,000 RPM, and typically within a range of from 5,000 to 8,500 RPM. However, it will be appreciated that the present subject matter is not limited to such commercially available tools and thus includes other tools with different operating characteristics, both commercially available and otherwise.

Cutting Systems

The present subject matter provides cutting systems which enable a separable electrically powered rotary blade assembly and particularly a portable handheld electrically powered tool to be mounted and/or incorporated in the cutting system and then used in a wide array of applications such as cutting large surfaces of concrete or like materials. Upon engagement of the portable tool in the cutting system, the tool and its cutting blade can be selectively positioned to a desired cut depth and/or cut angle. Additionally, upon incorporation of the portable tool into the cutting system, a wheeled base of the system enables an operator to easily move the tool relative to the surface or workpiece to be cut. The cutting system includes one or more positionable handles that extend from the cutting system for ease in operator use. And, in many versions of the present subject matter, the cutting systems include collection systems that collect dust and debris generated during cutting operation(s). In certain embodiments, the cutting systems include one or more swiveling wheels typically located along a rear region of the base unit. The swiveling wheel(s) is positionable about a vertical axis. Such rearwardly disposed swivelable wheel(s) promote maneuverability and ease of use of the cutting tool. These and other aspects are all described in greater detail as follows.

As described herein, in certain uses of the present subject matter cutting systems, a handheld electric rotary cutting tool is incorporated and positioned in the wheeled base unit such that upon operation of the cutting tool the rotary blade of the tool rotates in an "up-cut" direction or in a "down-cut" direction. The term "up-cut" refers to a direction of blade travel relative to a surface or workpiece to be cut in which a leading blade edge travels in an upward direction as that portion of the blade passes fresh material to be cut. The term "down-cut" direction refers to a direction of blade travel opposite that of up-cut, in which a leading blade edge travels in a downward direction as that portion of the blade passes fresh material to be cut.

For certain cutting applications, incorporating and positioning the handheld electric rotary cutting tool in the wheeled base unit such that the tool blade rotates in a down-cut direction may be beneficial when using the system as a "crack chaser" as known in the art. Cutting concrete along an existing crack or depression using a down-cut blade direction may be helpful as blade visibility is promoted. An up-cut blade direction may be useful for performing straight line cuts.

In certain embodiments of the present subject matter, the provisions for receiving and removably engaging a handheld electric rotary cutting tool include one or more selectively positionable inclination assemblies. The inclination assembly is positionable between a first position in which upon receipt and engagement of the handheld electric rotary cutting tool therein a blade of the tool is oriented vertically, and a second position in which the blade of the tool is oriented at least about 15° from the first position, toward a horizontal position. The inclination assembly can also be selectively positioned to any position between the first and second positions. In many versions, the inclination assembly is selectively positionable to a second position that is 45° or greater from the first position, toward a horizontal position. The references to "horizontal position" and "vertical position" in this regard refer to the blade of the handheld electric rotary cutting tool extending within a plane that extends in a horizontal or vertical direction.

FIG. 1 illustrates an embodiment of a cutting system 10 in accordance with the present subject matter. The cutting system 10 comprises a base unit 20 or wheeled base as periodically referred to herein and a handle assembly 30 secured to the base 20. The base unit 20 includes provisions 40 for receiving and removably engaging a handheld electric rotary cutting tool 50. The base unit 20 also includes provisions 60 for collecting dust and debris resulting from a cutting operation. References to "front" and "rear" directions of the cutting system are based upon the front direction designated as arrow F and rear direction shown as arrow R in FIG. 1. Front and rear directions are generally opposite from one another. Generally, the front is the region of the cutting system at which the cutting tool blade is located upon incorporating the cutting tool 50 in the provisions 40 as described herein.

The wheeled base 20 includes at least one wheel and in many embodiments, at least one front wheel 22 and at least one swiveling rear wheel 24. The term "swiveling" as used herein refers to a wheel designated as such configured to be positionable about a vertical axis, which is in addition to the wheel being rotatable about a horizontal axis typically in the form of a corresponding axle. Swiveling wheels or wheel assemblies are known in the art and commonly referred to as "caster wheels." Such wheels are commercially available from numerous sources. Although the rear wheel(s) are typically provided as swiveling wheels, the present subject matter also includes cutting systems having one or more front wheel(s) that swivel in addition to, or instead of, rear swiveling wheel(s).

The handle assembly 30 defines a distal end 32 typically having one or more grips or laterally extending members 31 for an operator to grasp, and an opposite proximal end 34 hingedly or movably affixed to the wheeled base 20. A pivoting handle base assembly 70 described in greater detail herein, provides selective and adjustable positioning of the handle 30 relative to the wheeled base 20. In many embodiments, the pivoting handle assembly base 70 enables the handle 30 to be positioned toward a rear of the cutting system 10 up to 45° from vertical. And, in particular versions, the pivoting handle base assembly 70 enables the handle 30 to be positioned toward a front of the cutting system up to 45° from vertical. In addition to enabling such positions for the handle 30, the pivoting handle base assembly 70 also enables selective securement or "locking" of the handle 30 in a desired angular position relative to the wheeled base 20. These features promote operator ease of use and enable an operator to stand or walk behind or in front of the cutting system during use. Additional details of the pivoting handle base assembly are provided herein.

In many versions of the cutting systems, the handle assembly 30 includes a controller 80 having a power input 82, a power output 84, and one or more switches 86 for controlling electrical power to the output 84. As will be appreciated, upon incorporation of a cutting tool 50 in the provisions 40, the electrical power cord of the cutting tool is connected to the power output 84 of the controller 80. Upon connecting the power input 82 to a source of electrical power, operation and/or actuation of the cutting tool 50 also depends upon the switches 86. Thus, if the actuation controls of the cutting tool 50, typically accessible along the housing of the tool, are in an "on" state, then operation or actuation of the cutting tool 50 depends upon the state(s) of the switches 86 of the controller 80. The handle assembly 30 can also include cord wrap members 36 and a variety of other features. Thus, it will be appreciated that the present subject matter is not limited to the particular embodiments described herein, and instead includes a variety of other configurations.

Figure 2:
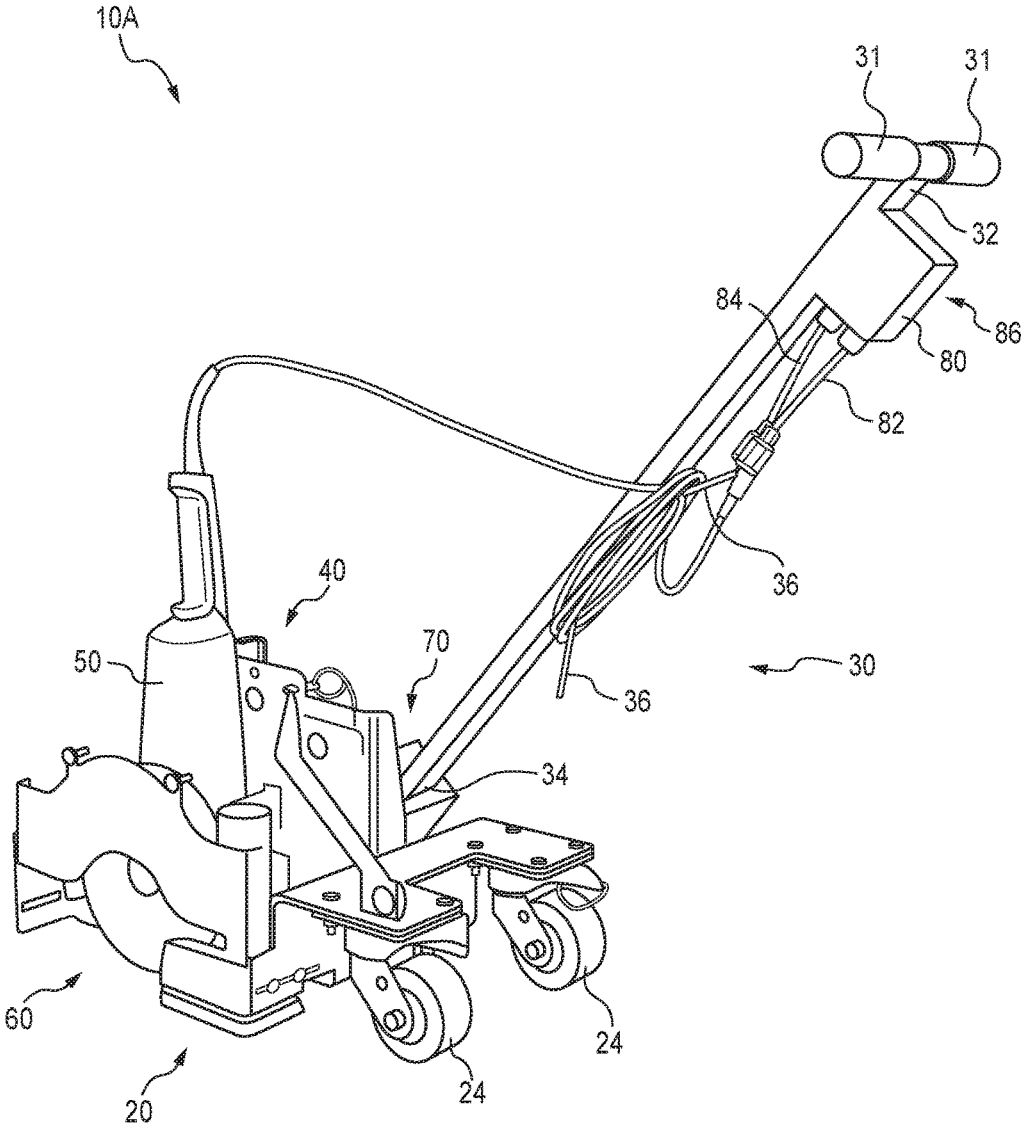
FIG. 2 is a rear perspective view of another embodiment of a cutting system in accordance with the present subject matter.

FIG. 2 illustrates another embodiment of a cutting system 10A in accordance with the present subject matter. The cutting system 10A generally corresponds to the cutting system 10, however is configured for use with larger and/or heavier cutting tools 50. Thus, the cutting system 10A is deemed a "heavy duty" version as compared to the cutting system 10. All or a portion of the features of the cutting system 10 can be included in the system 10A. in FIG. 2 depicting the cutting system 10A, components the same or similar to components identified and described in the system 10 are identified with the same reference numbers. Thus, for example, the handle assembly used in the system 10A is the same or similar to the handle assembly 30 of system 10, and so shown as item 30 in FIG. 2.

In the descriptions of various features and aspects of the cutting systems, certain details will be primarily described with reference to the cutting system 10A, and other details primarily described with reference to the cutting system 10. For clarity, it will be understood that FIGS. 3-7 and 12-13 are based upon the cutting system 10 of FIG. 1, and FIGS. 8-11 and 14-16 are based upon the cutting system 10A of FIG. 2. However, it will be understood that any or all of these features can be included in either version of FIG. 1 or 2, or in any other version in accordance with the present subject matter.

Figure 3:
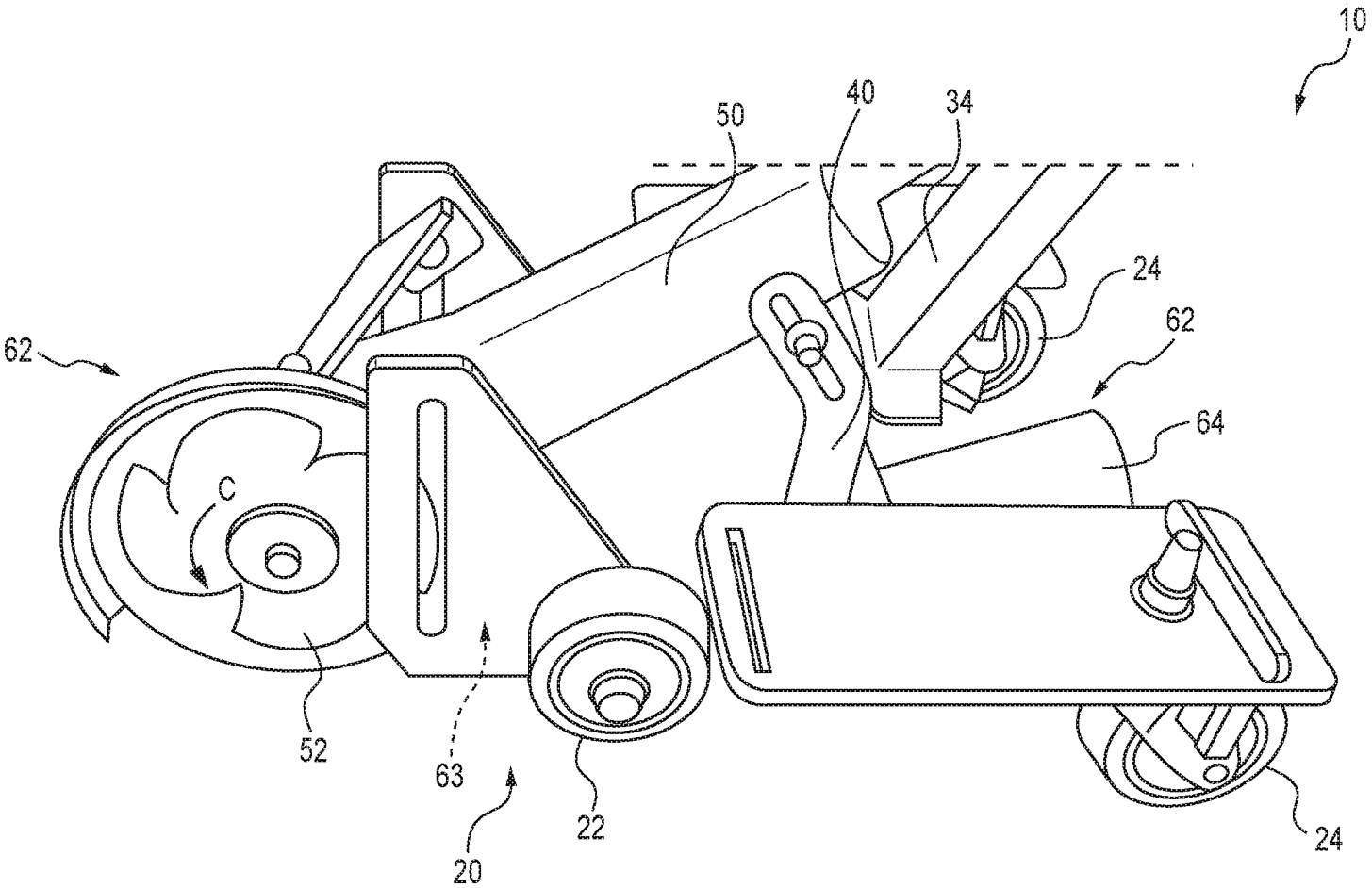
FIG. 3 is a side assembly view of the system of FIG. 1 illustrating engagement of a cutting tool with a wheeled base unit and a dust and debris collection system in accordance with the present subject matter.
Figure 4:
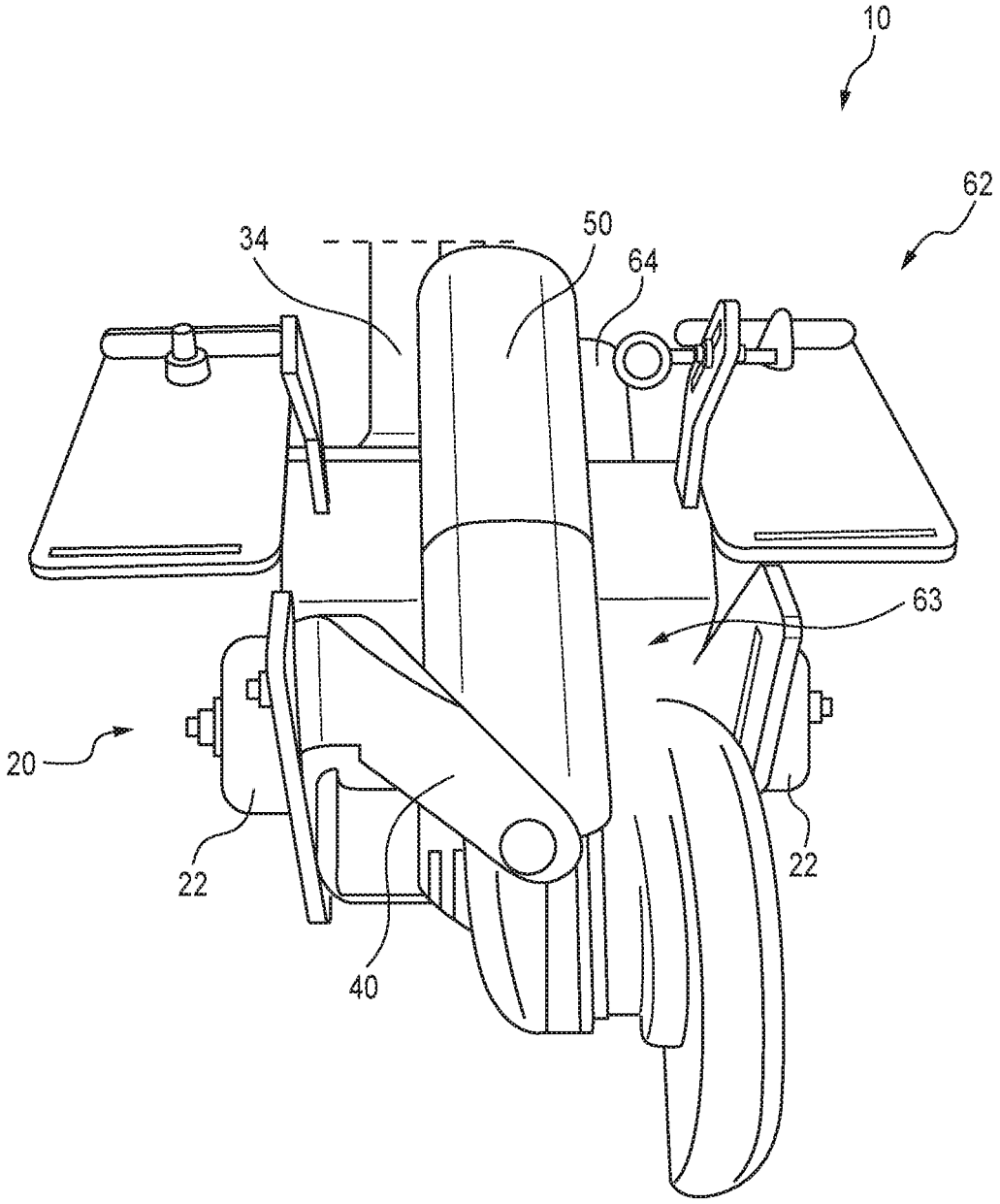
FIG. 4 is a front view of the assembly shown in FIG. 3 showing the cutting tool oriented in a position such that the cutting tool blade rotates in a down-cut direction.
Figure 5:
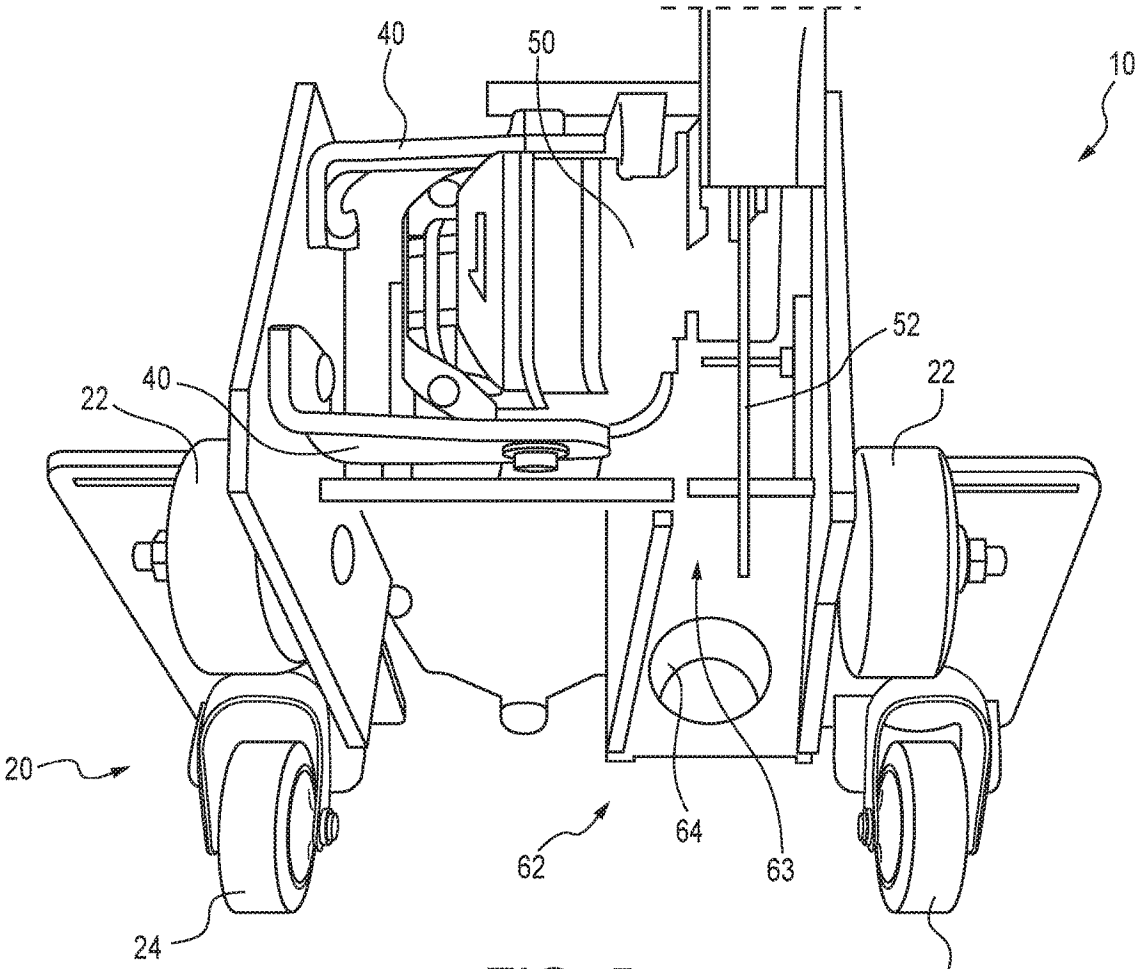
FIG. 5 is a front underside view of the assembly shown in FIGS. 3-4 further illustrating aspects of the cutting system and particularly the dust and debris collection system.
Figure 6:
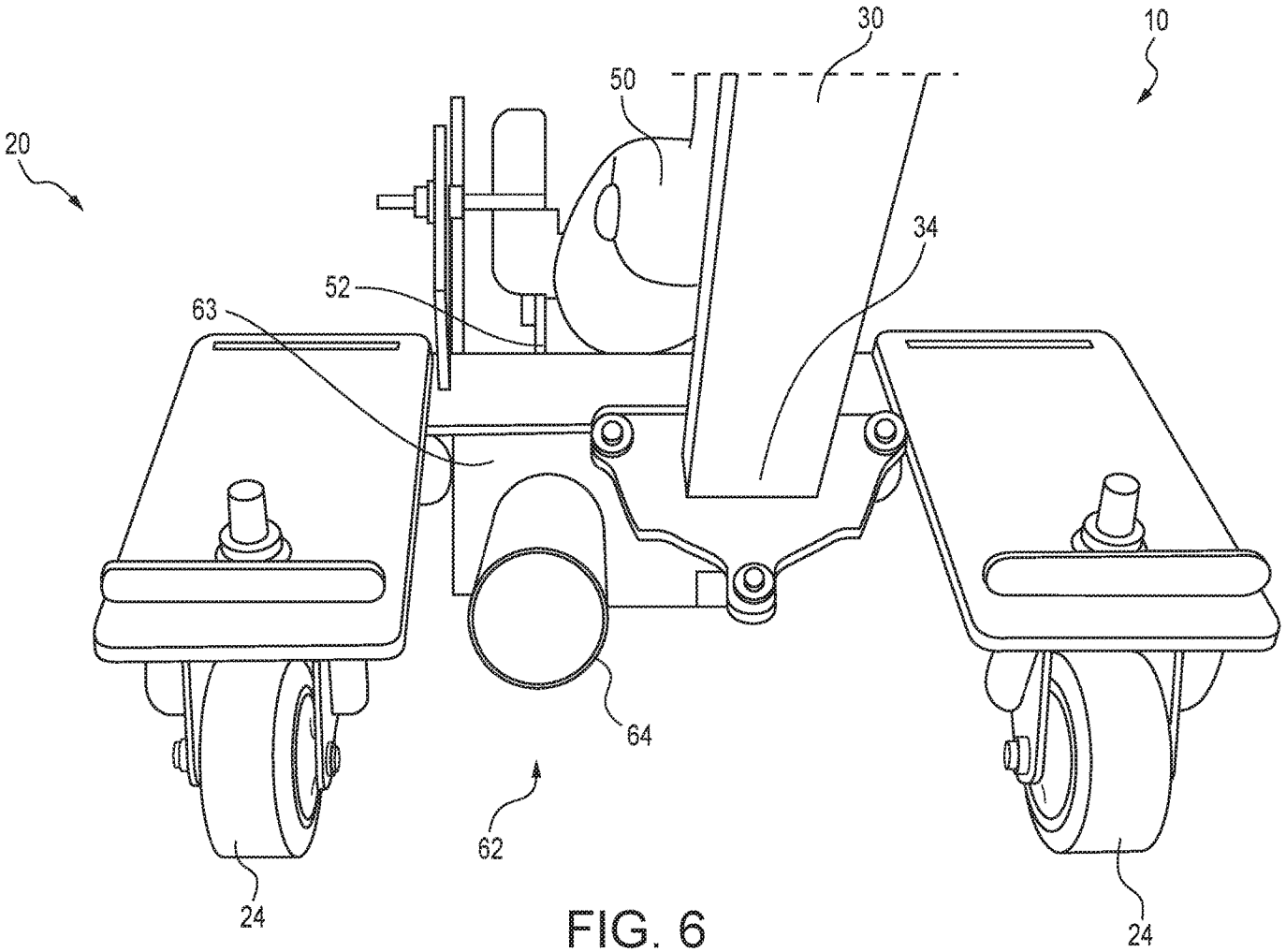
FIG. 6 is a rear view of the assembly of FIGS. 3-5 further showing aspects of the cutting system and particularly the dust and debris collection system.
Figure 7:
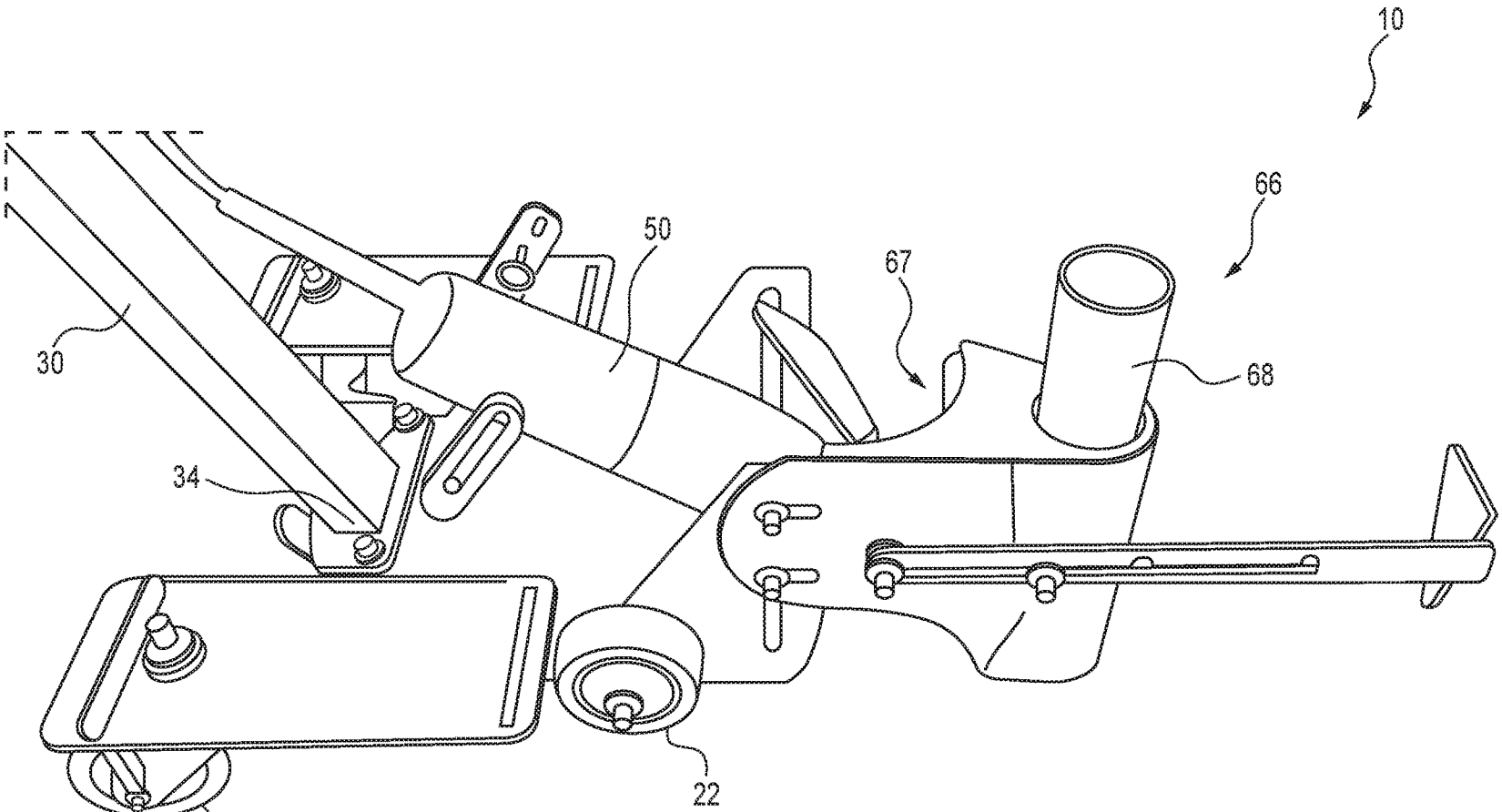
FIG. 7 is a top side view of the assembly of FIGS. 3-6 showing the cutting tool oriented in a position such that the cutting tool blade rotates in an up-cut direction.

As previously noted, the cutting systems of the present subject matter enable a cutting tool to be incorporated in the system such that upon operation of the tool and rotation of a cutting blade, the tool is positioned such that the blade rotates in a down-cut direction, or in an up-cut direction. FIGS. 3-6 illustrate the cutting tool 50 positioned so that a cutting blade 52 of the tool down-cuts. FIG. 7 illustrates the cutting tool 50 positioned so that the blade of the tool up-cuts. In this example of tool positioning to achieve either down-cut or up-cut, it will be understood that upon viewing the unobstructed or open face of the cutting tool blade, such as shown in FIG. 3, blade rotation direction is counterclockwise as depicted by arrow C.

In many embodiments of the present subject matter, the cutting system includes one or more dust and debris collection system(s) which are configured to collect such dust and debris which are generated or emitted from the cutting area, i.e., the interface between the cutting tool blade and surface or substrate being cut. In particular versions, the cutting systems include a first dust and debris collection system that collects such from the cutting tool when the cutting tool is engaged to the wheeled base in a position such that the blade up-cuts; and a second dust and debris collection system that collects such from the cutting tool when the cutting tool is engaged to the wheeled base in a position such that the blade down-cuts. FIGS. 3-6 show a dust and debris collection system 62 for collecting such in a down-cut configuration. This down-cut dust and debris collection system includes a receptacle 63 having an entrance or open end directed toward the cutting blade, and a discharge port 64 for directing collected dust and debris to a reservoir (not shown) or other location or component. FIG. 7 shows a dust and debris collection system 66 for collecting such in an up-cut configuration. This up-cut dust and debris collection system includes a receptacle 67 having an entrance or open end directed toward the cutting blade, and a discharge port 68 for directing collected dust and debris to a reservoir (not shown) or other location or component.

Figure 8:
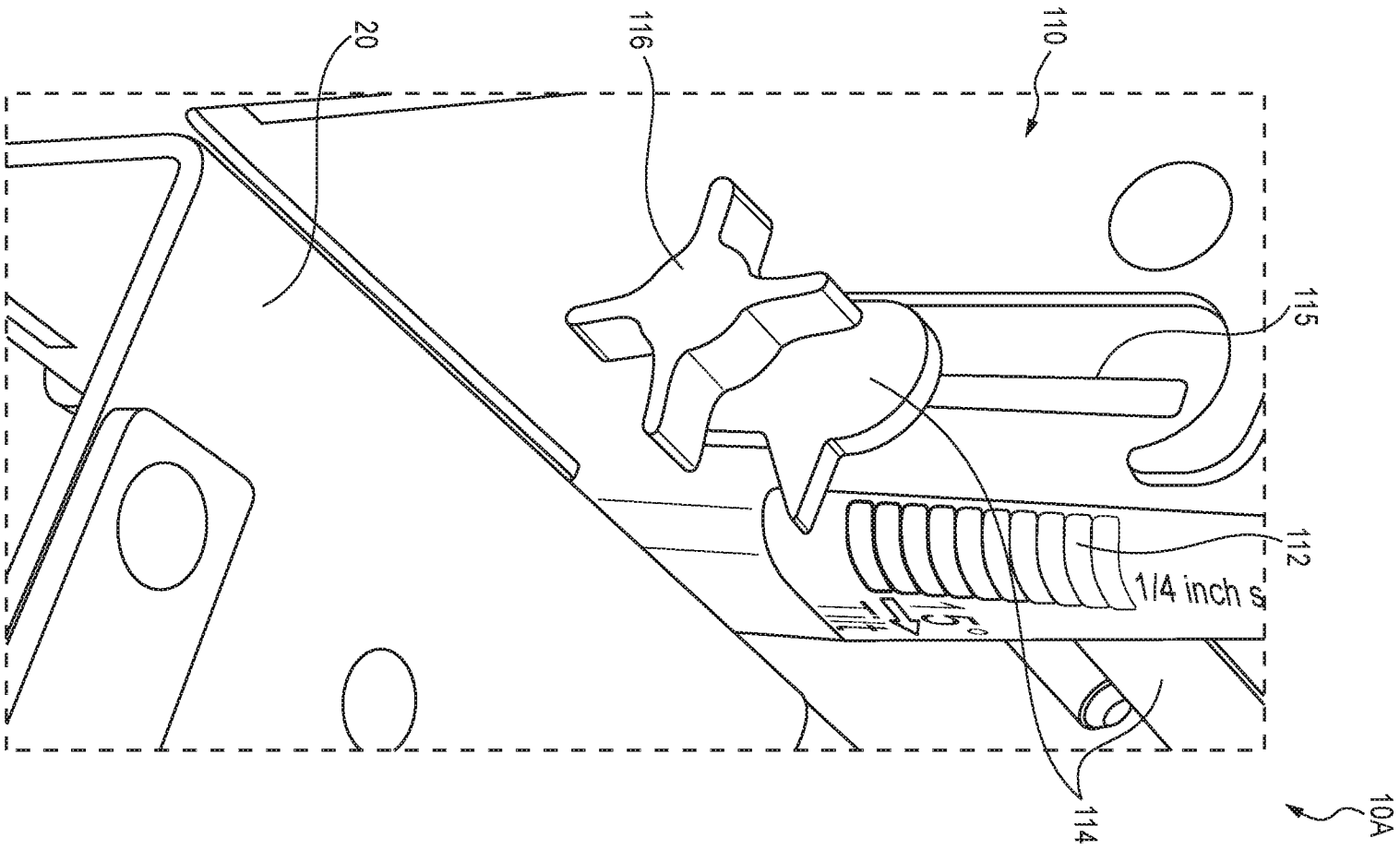
FIGS. 8 and 9 are detailed views of indicator scales used with a blade depth assembly and an inclination assembly used for selectively positioning the cutting tool relative to the wheeled base, in accordance with an embodiment of the present subject matter.

FIG. 8 illustrates an indicator scale 112 used with a blade depth assembly 110 for selectively positioning the cutting tool (not shown) relative to the wheeled base 20. The blade depth assembly 110 enables the cutting tool to be selectively positioned such that the cutting blade is positioned at a desired depth of cut relative to the substrate to be cut. The indicator scale 112 provides a convenient guide for an operator to refer to while adjusting cutting blade depth. The blade depth assembly includes a mounting plate or components thereof 114 to which is secured the provisions for receiving the cutting tool (not shown). The mounting plate 114 can be positionably adjusted and secured to the wheeled base 20 by use of one or more fasteners 116 extending through a slot or aperture 115 in the plate 114 and/or base 20. It will be understood that a variety of blade depth adjustment assemblies can be used in the cutting systems.

Figure 9:
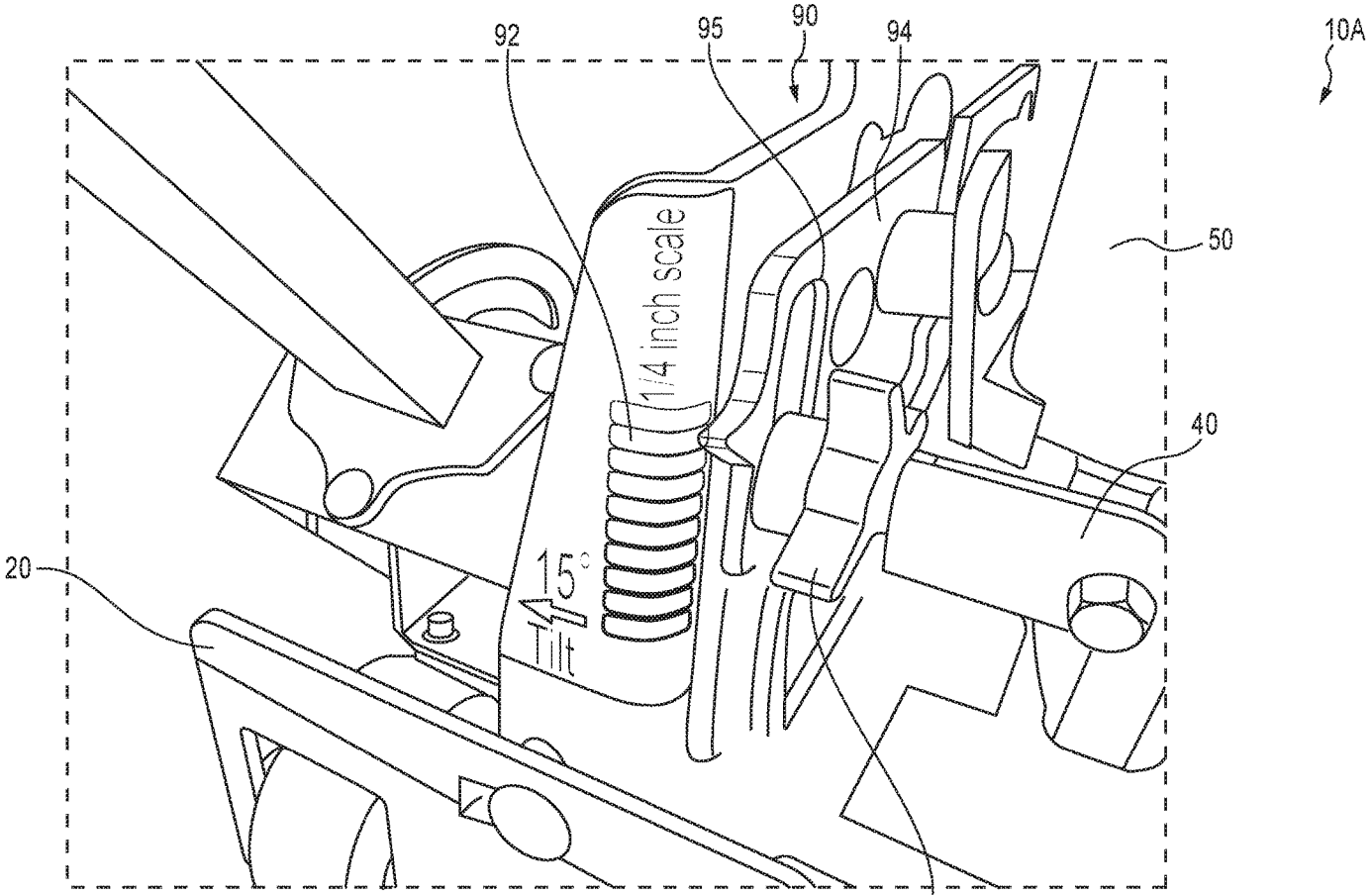

FIG. 9 illustrates an indicator scale 92 used with an inclination assembly 90 for selectively positioning the cutting tool 50 relative to the wheeled base 20. The inclination assembly 90 enables the cutting tool 50 to be selectively positioned such that the cutting blade is oriented vertically or to a position that the blade is oriented at a non-vertical or angled position. The indicator scale 92 provides a convenient guide for an operator to refer to while adjusting cutting blade position and angle. Although the inclination assembly 90 can take a variety of forms and configurations, in many versions, the inclination assembly 90 includes a mounting plate 94 to which is secured the provisions 40 for receiving cutting tool 50. The mounting plate 94 can be positionably adjusted and affixed to the wheeled base 20 by use of one or more fasteners 96 extending through a slot 95 or other opening in the plate 94 and/or base 20. As will be understood, upon loosening the fastener 96, the mounting plate 94 can be positionably adjusted relative to the wheeled base 20. Upon positioning to a desired position of the tool 50, e.g., a desired angled position for the cutting blade, the fastener 96 is tightened or otherwise engaged to thereby maintain the desired position. Depending upon the particular assembly, it may be necessary to also loosen one or more tool mounting members 41 depicted in FIG. 16, which are used to engage a tool support member to the wheeled base 20. It will be understood that the present subject matter includes a wide array of assemblies and configurations for selectively positioning the angular position of the cutting blade and is not limited the specific configuration shown in the accompanying figures.

Figure 10:
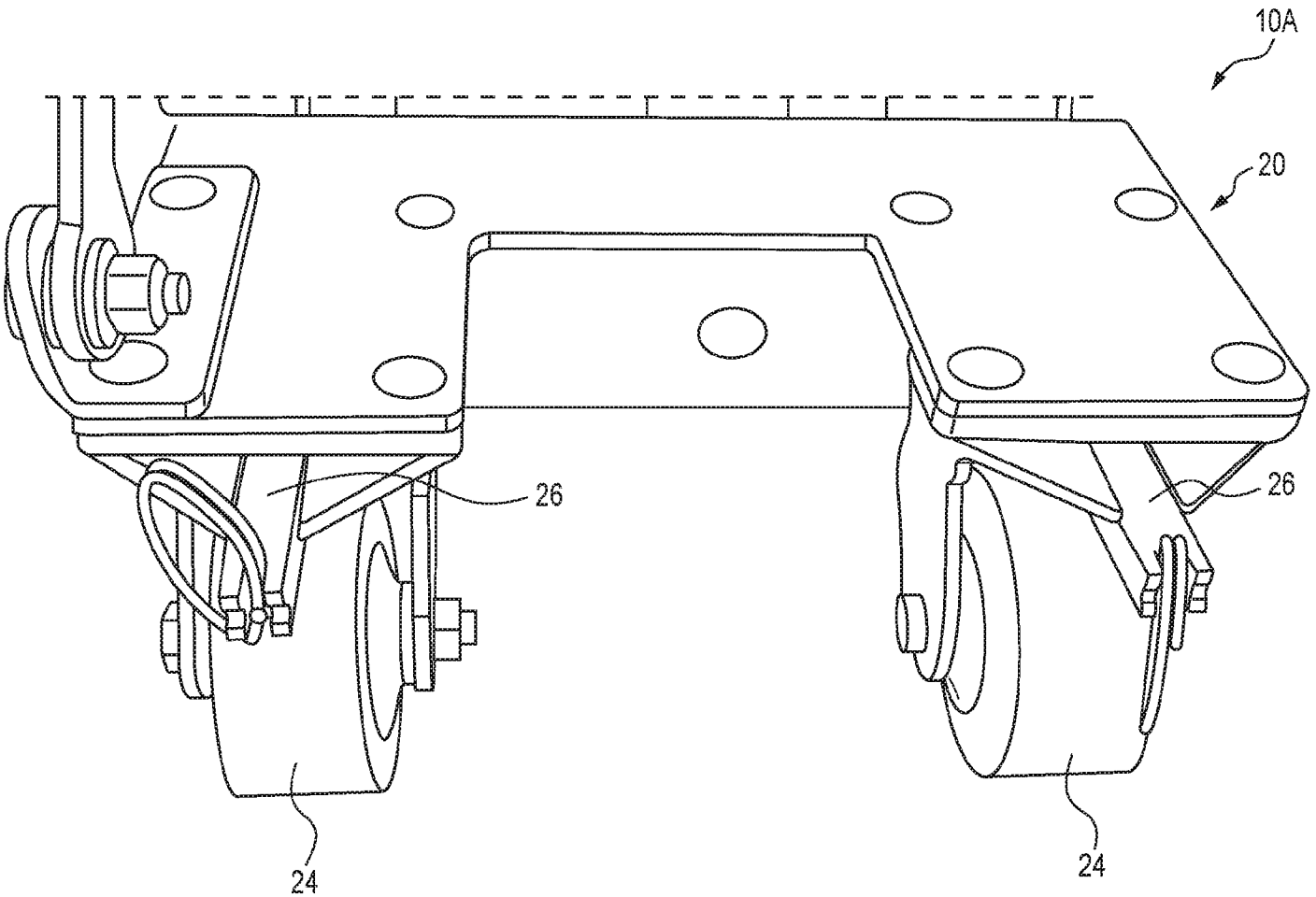
FIGS. 10-13 are detailed views of swiveling wheels and removable wheel lock carriages to affix a swiveling wheel in a non-swiveling and stationary position in accordance with an embodiment of the present subject matter.
Figure 11:
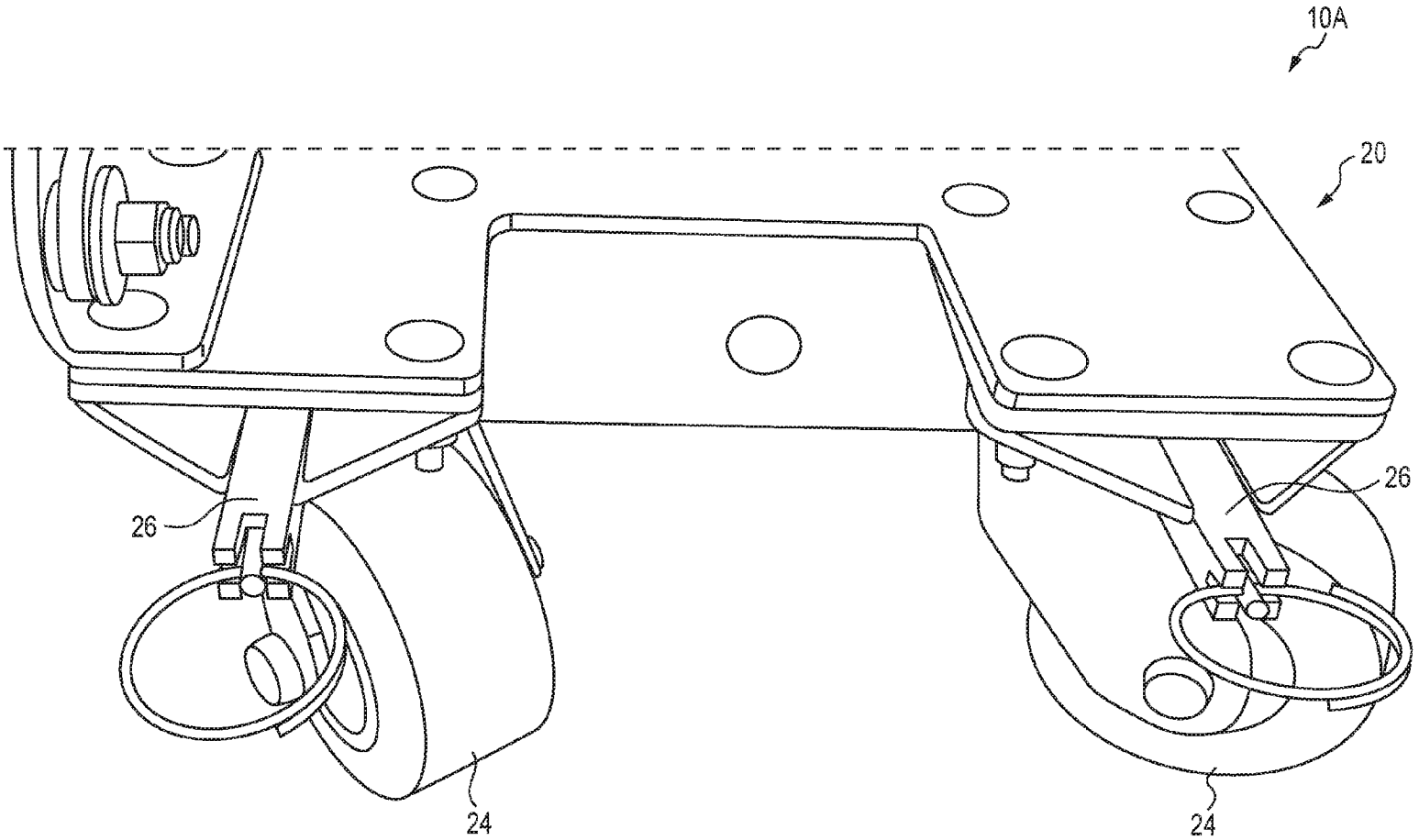
Figure 12:
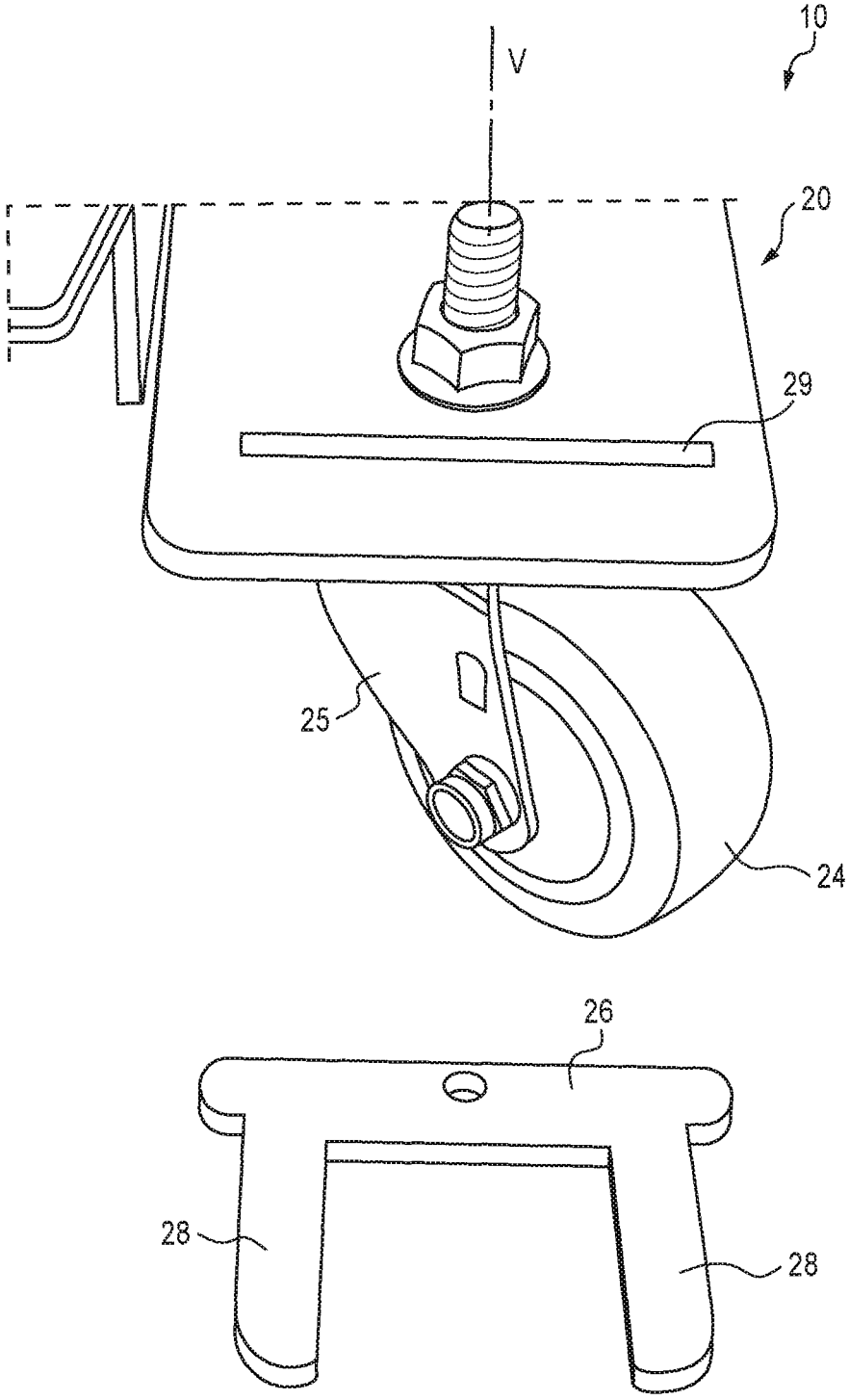
Figure 13:
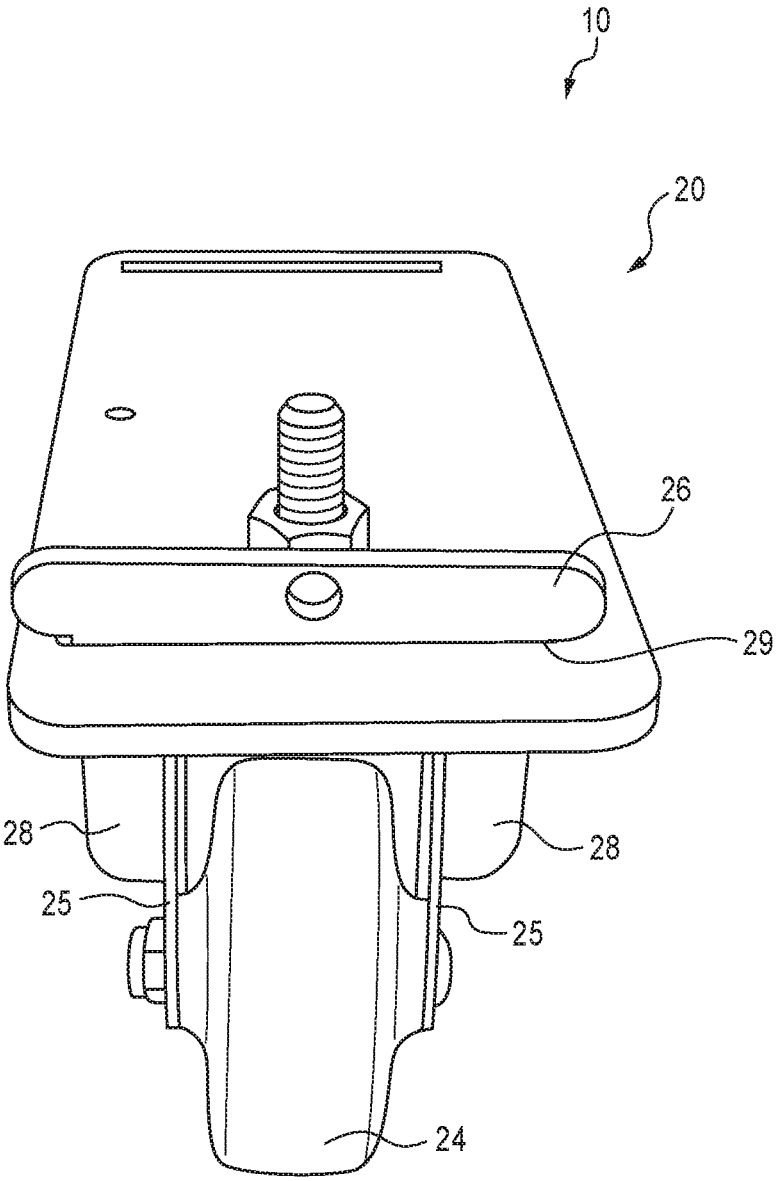

FIGS. 10-13 illustrate aspects of the swiveling wheel(s) 24 of the wheeled base 20. In many embodiments, for each swiveling wheel 24, a removable wheel lock carriage 26 is provided that serves to lock an otherwise swiveling wheel in a stationary position. Referring to FIGS. 12 and 13, without the wheel lock carriage, a swiveling wheel 24 is positionable about a vertical axis shown in FIGS. 12 and 13 as axis V. Upon placement of the carriage 26 over the wheel 24, the carriage 26 locks the wheel in a stationary position. In many embodiments, the wheel lock carriage 26 locks the wheel 24 in a position such that the wheel is oriented straight toward a front or rear of the cutting system. Although the wheel lock carriage 26 can take a wide array of different forms, the version shown in FIG. 12 has been found to be reliable and convenient to use. In this version, the wheel lock carriage 26 is U-shaped having two outwardly extending and generally parallel carriage arms 28. Corresponding carriage arm apertures 29 are defined in the wheeled base and receive the arms 28 upon placement of the carriage 26 over a wheel 24. Upon such placement, the arms 28 extend alongside the wheel 24 and in many applications contact a wheel axle support 25, thereby precluding swiveling motion of the wheel, such as about axis V. Referring to FIGS. 10-11, another version of selectively lockable swiveling wheels 24 is depicted. In this version, a horizontally slideable wheel lock carriage 26 is selectively positionable to lock the otherwise swiveling wheels 24 from an unlocked position shown in FIG. 11 to a locked position depicted in FIG. 10.

Figure 14:
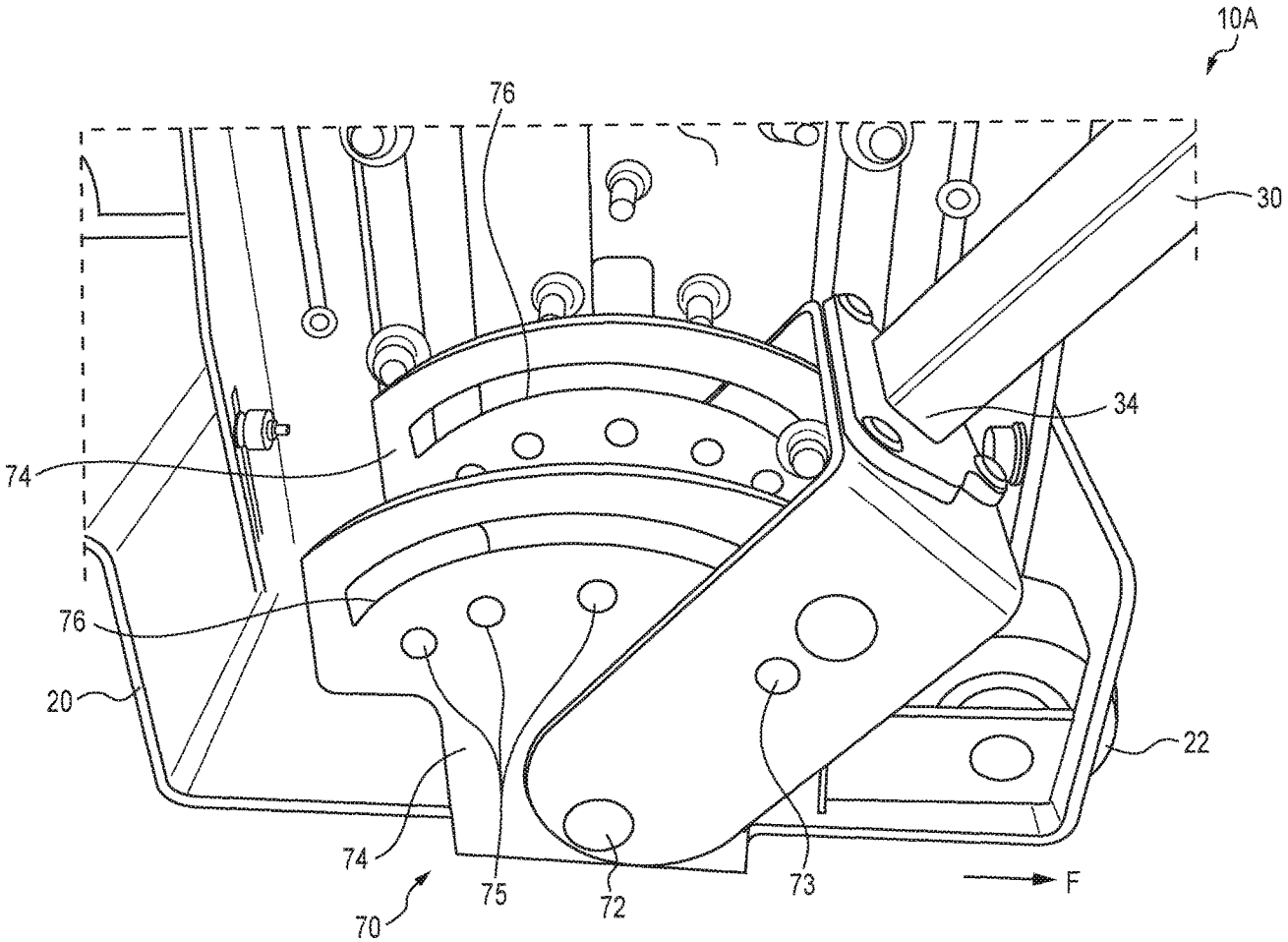
FIGS. 14-15 are detailed views of a pivoting handle assembly in accordance with an embodiment of the present subject matter.
Figure 15:
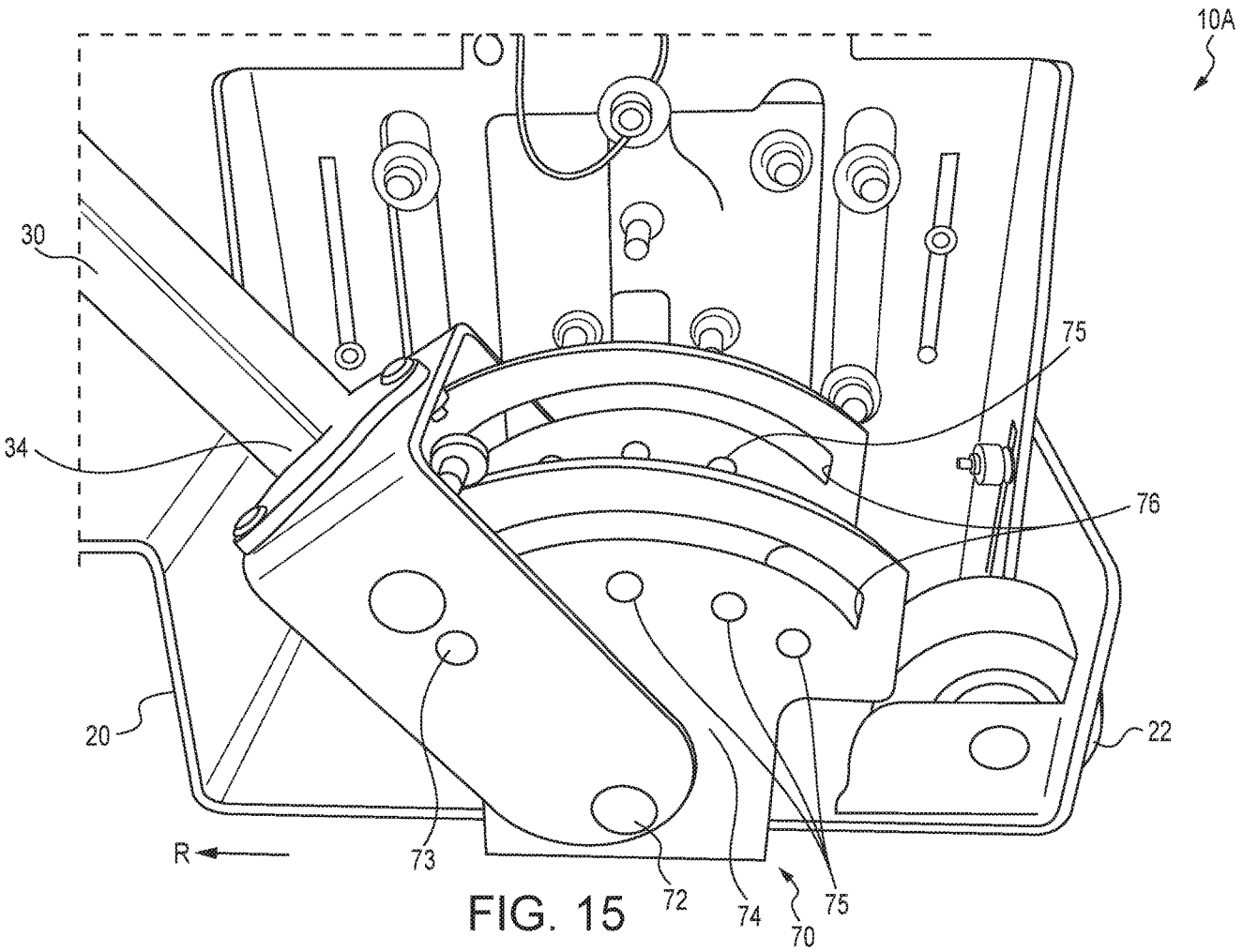
Figure 16:
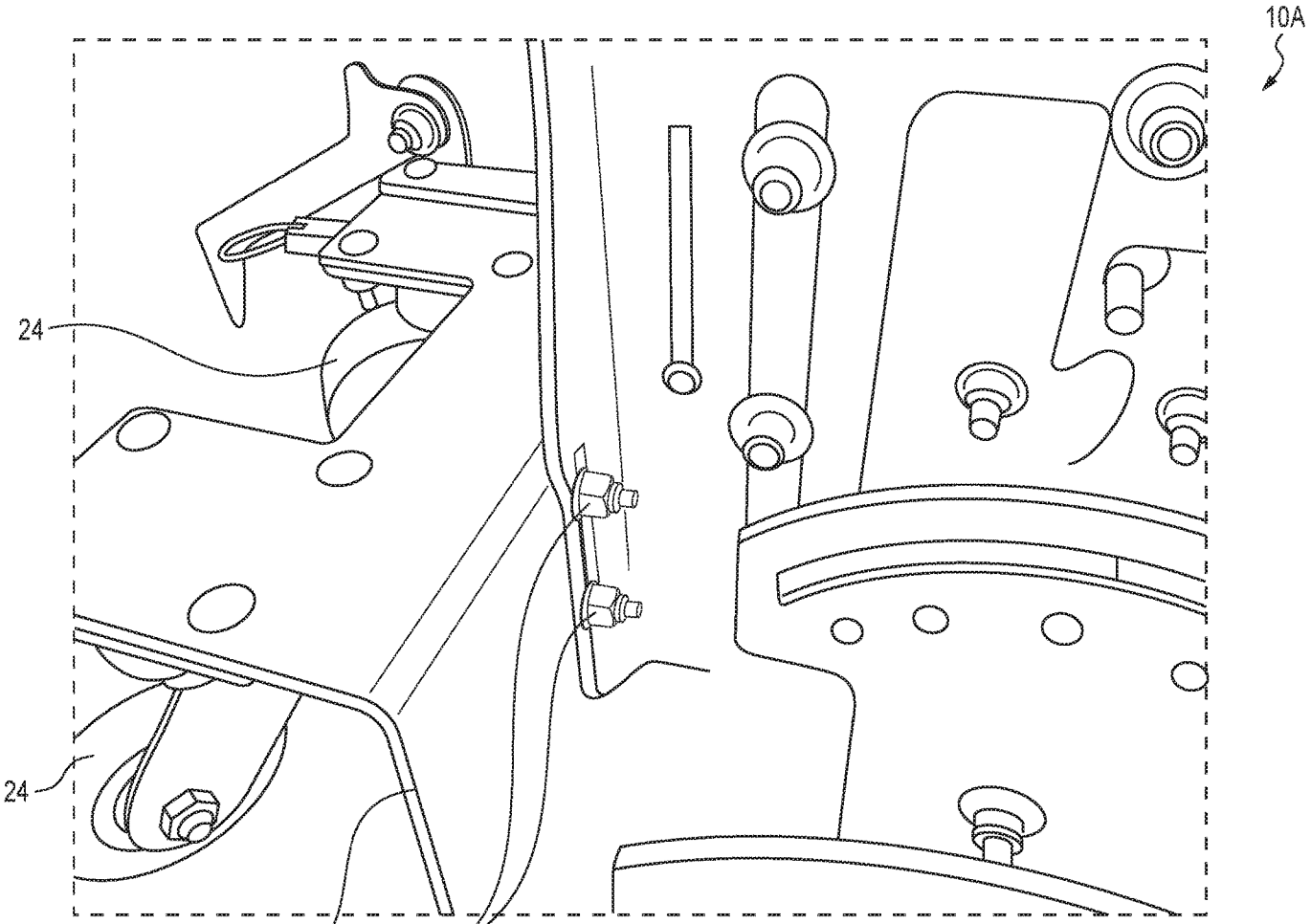
FIG. 16 is a detailed view further illustrating affixment of a mounting plate that receives the cutting tool in accordance with an embodiment of the present subject matter.

FIGS. 14-15 illustrate in greater detail the pivoting handle base assembly 70. The pivoting handle base assembly is located between the proximal end 34 of the handle 30 and the wheeled base 20. The pivoting handle assembly 70 generally comprises a pivot 72, and one or more guide plate(s) 74 defining one or more arcuate slots 76 or members. The pivot 72 is pivotally attached to the guide plate 74 and/or the wheeled base 20 and can be selectively positioned toward either a frontward position such as shown in FIG. 14 or a rearward position such as shown in FIG. 15. The pivoting handle base assembly 70 can additionally include releasable locking provisions to secure the handle in a desired position. A typical form of such locking provisions is a locking pin 73 that is selectively engageable with both the handle 30 and the guide plate 74. A plurality of apertures 75 can be provided in the guide plate 74 corresponding to predetermined handle positions. The pivoting handle base assembly 70 is configured to provide a wide range of positions for the handle assembly 30. In many embodiments, the pivot 72 and thus handle 30 can be positioned at an angle of 45° toward the front of the cutting system and an angle of 45° toward the rear of the cutting system.

The present subject matter cutting systems enable a user to select either an up-cut configuration or a down-cut configuration by the manner in which the user incorporates the handheld cutting tool in the cutting system. As previously described, if the cutting tool is positioned in a position such that the blade up-cuts or down-cuts, an opposite cutting configuration can be obtained by repositioning the cutting tool in the cutting system. In many versions, the cutting tool is repositioned by rotating the tool 180° about its longitudinal axis. For example, if upon positioning the tool in the cutting system to achieve a down-cut configuration the open face of the cutting blade is directed to a left side of the cutting system; an up-cut configuration can be achieved by repositioning the tool in the cutting system such that the open face of the cutting blade is directed to a right side of the cutting system.

The present subject matter cutting systems also enable a user to select either an up-cut configuration or a down-cut configuration by the orientation of the handle and direction of use adopted by a user. For example if the cutting system is configured to down-cut as the system is moved in a forward direction, it will be appreciated that an up-cut operation can be achieved if the system is moved in an opposite direction, e.g., a rearward direction. The present subject matter cutting systems may include a selectively positionable handle assembly that can be angled forward or rearward. The orientation and/or direction of handle inclination provides a user with ability to move the cutting system in either a forward or rearward direction, and/or by pushing or pulling the system. These features enable an operator to easily and conveniently change from a down-cut configuration to an up-cut configuration, or vice-versa.

Many other benefits will no doubt become apparent from future application and development of this technology.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as described herein.

What is claimed is:

1. A cutting system comprising:

a wheeled base unit having (i) provisions for receiving and removably engaging a handheld electric rotary cutting tool, wherein the provisions for receiving and removably engaging the handheld electric rotary cutting tool include an inclination assembly selectively positionable between a first position in which upon receipt and engagement of the handheld electric rotary cutting tool therein a blade of the tool is oriented vertically, and a second position in which the blade of the tool is oriented at an angle of 15° from the first position, toward a horizontal orientation, and (ii) provisions for adjustably positioning the cutting tool relative to the wheeled base, wherein the wheeled base has at least one front wheel and at least one swiveling rear wheel, wherein the rear wheel is positionable about a vertical axis;

a handle assembly secured to the base unit;

provisions on the wheeled base unit for collecting dust and debris resulting from a cutting operation;

at least one removable wheel lock carriage configured to slidably engage a swiveling rear wheel and upon engagement therewith, affix the rear wheel to a stationary position relative to its vertical axis.

2. The cutting system of claim 1 further comprising:

a handheld electric rotary cutting tool.

3. The cutting system of claim 2 wherein the electric cutting tool includes (i) a housing, (ii) an electrically powered motor disposed in the housing, (iii) a rotatable shaft powered by the motor and transversely oriented to an axis of the motor, and (iv) actuation controls for controlling operation of the tool, the actuation controls accessible along the housing of the tool.

4. A cutting system comprising:

a base unit having at least one wheel and provisions for receiving and removably engaging a handheld electric rotary cutting tool including a powered shaft rotatable in a first direction, wherein the provisions (i) enable the cutting tool to be engaged relative to the base unit in a first position such that upon rotation of the powered shaft of the cutting tool in the first direction, the shaft rotates in an up-cut direction and (ii) also enable the cutting tool to be engaged relative to the base unit in a second position such that upon rotation of the powered shaft of the cutting tool in the first direction, the shaft rotates in a down-cut direction;

a handle assembly secured to the base unit.

5. The cutting system of claim 4 further comprising a handheld electric rotary cutting tool including (i) a housing, (ii) an electrically powered motor disposed in the housing, (iii) a rotatable shaft powered by the motor and transversely oriented to an axis of the motor, and (iv) actuation controls for controlling operation of the tool, the actuation controls accessible along the housing of the tool.

6. The cutting system of claim 4 wherein the base unit has at least one front wheel and at least one swiveling rear wheel, wherein the rear wheel is positionable about a vertical axis.

7. The cutting system of claim 6 further comprising:

at least one removable wheel lock carriage configured to slidably engage a swiveling rear wheel and upon engagement therewith, affix the rear wheel to a stationary position relative to its vertical axis.

8. The cutting system of claim 4 wherein the base unit further includes provisions for collecting dust and debris resulting from a cutting operation.

9. The cutting system of claim 4 wherein the provisions for receiving and removably engaging the handheld electric rotary cutting tool include an inclination assembly selectively positionable between a first position in which upon receipt and engagement of the handheld electric rotary cutting tool therein a blade of the tool is oriented vertically, and a second position in which the blade of the tool is oriented at an angle of 15° from the first position, toward a horizontal orientation.

10. A cutting system comprising:

a base unit having at least one wheel and provisions for receiving and removably engaging a handheld electric rotary cutting tool having a powered shaft in either (i) a first position such that upon rotation of the powered shaft of the cutting tool in a first direction, the shaft rotates in an up-cut direction, or (ii) a second position such that upon rotation of the powered shaft of the cutting tool in the first direction, the shaft rotates in a down-cut direction;

a first dust and debris collection system positioned on the base unit to collect dust and debris from the cutting tool when the cutting tool is engaged to the base unit and in the first position;

a second dust and debris collection system positioned on the base unit to collect dust and debris from the cutting tool when the cutting tool is engaged to the base unit and in the second position.

11. The cutting system of claim 10 further comprising a handheld electric rotary cutting tool including (i) a housing, (ii) an electrically powered motor disposed in the housing, (iii) a rotatable shaft powered by the motor and transversely oriented to an axis of the motor, and (iv) actuation controls for controlling operation of the tool, the actuation controls accessible along the housing of the tool.

12. The cutting system of claim 10 wherein the base unit has at least one front wheel and at least one swiveling rear wheel, wherein the rear wheel is positionable about a vertical axis.

13. The cutting system of claim 12 further comprising:

at least one removable wheel lock carriage configured to slidably engage a swiveling rear wheel and upon engagement therewith, affix the rear wheel to a stationary position relative to its vertical axis.

14. The cutting system of claim 10 wherein the provisions for receiving and removably engaging the handheld electric rotary cutting tool include an inclination assembly selectively positionable between a first position in which upon receipt and engagement of the handheld electric rotary cutting tool therein a blade of the tool is oriented vertically, and a second position in which the blade of the tool is oriented at an angle of 15° from the first position, toward a horizontal orientation.

* * * * *